United States Patent [19]

Shaw et al.

[11] 3,980,361

[45] Sept. 14, 1976

[54] EXPANDABLE DISPLAY SYSTEM

[76] Inventors: Jerry Shaw, 50 W. Fairlawn Blvd.; Samuel G. Solitt, 2121 Brookshire Road, both of Akron, Ohio 44313

[22] Filed: Mar. 28, 1975

[21] Appl. No.: 562,872

[52] U.S. Cl. ..... 312/223; 312/198; 312/140.1; 240/6

[51] Int. Cl.[2] ..... A47B 53/00; A47F 3/00

[58] Field of Search ..... 312/223, 198, 234.1, 312/140, 118, 119; 240/6

[56] References Cited

UNITED STATES PATENTS

| | | | |
|---|---|---|---|
| 549,289 | 11/1895 | Floyd | 240/6 |
| 569,257 | 10/1896 | Waldron et al. | 312/198 |
| 747,741 | 12/1903 | Marsh | 312/118 |
| 842,669 | 1/1907 | Hughes | 312/198 |
| 1,369,902 | 3/1921 | Miller et al. | 312/198 |
| 1,568,729 | 1/1926 | Gearon | 312/223 |
| 1,763,716 | 6/1930 | Michaelson | 312/118 |
| 2,517,963 | 8/1950 | Bausch | 240/6 |
| 2,658,810 | 11/1953 | Ellis et al. | 312/140.1 |
| 2,828,928 | 4/1958 | Kollisch | 312/234.1 |
| 2,846,284 | 8/1958 | Fitzgerald | 312/119 |
| 3,667,826 | 6/1972 | Wood et al. | 312/118 |
| 3,700,877 | 10/1972 | Wilson | 240/3 |
| 3,741,617 | 6/1973 | Gloyd | 312/118 |
| D91,966 | 4/1934 | Sawin | 312/118 |
| R23,025 | 8/1948 | Burdick et al. | 312/223 |

*Primary Examiner*—Paul R. Gilliam
*Assistant Examiner*—Victor N. Sakran

[57] ABSTRACT

An expandable display system for displaying small articles, such as jewelry, is disclosed which includes a plurality of similar modules or sections which can be combined and expanded to any desired length. Each section includes an upstanding vertical wall unit with an overhanging canopy suitably provided with lighting fixtures. Each of the upstanding wall units has a color-coded display portion thereon, and alternate units have showcases or display cabinets attached thereto. Each of the upstanding units is contemplated as being four foot in length with two-foot end units being provided, and by combining a plurality of units, a display assembly of any desired length in multiples of three can be provided. It is contemplated that an individual display assembly could be 16 feet, for example, and would thereby consist of three of the 4-foot upright units, with two of them having the display cases and the other two being without the cases and flanking the ones with display cases and having 2-foot end units at each end. Additional multiples can be achieved by simply joining adjacent display sections to each other.

6 Claims, 7 Drawing Figures

EXPANDABLE DISPLAY SYSTEM

BACKGROUND OF THE INVENTION

This invention, in general, relates to the art of display units for displaying merchandise for retail sales. In particular, the invention relates to a unique, expandable display system primarily intended for the display of articles of jewelry but not necessarily limited thereto.

DESCRIPTION OF THE PRIOR ART

Applicant is aware of the following prior patent art:
Levin — U.S. Pat. No. D-70,883
Bausch — U.S. Pat. No. 2,517,963
Fitzgerald — U.S. Pat. No. 2,846,284
Wood et al — U.S. Pat. No. 3,667,826
Wilson — U.S. Pat. No. 3,700,877

In addition to the aforementioned patent art, Applicant is aware of various types of display units for displaying jewelry. None of them, however, has the versatility of the present invention in that the invention is readily expandable by using what might be termed modules or display sections, while maintaining an excellent aesthetic appearance and also maintaining its utility while attractively and clearly displaying the merchandise.

SUMMARY OF THE INVENTION

It has been found that a unique display system can be provided by providing a plurality of upstanding members, each having an overhanging canopy, with these members being provided in approximately 4-foot width dimensions. Each unit is capable of being affixed to an adjoining unit so that multiple composite units are achievable, with the minimal assembly being contemplated as comprising two of the upstanding members.

It has been found that preferably three types of upstanding members are desirable to accomplish the desired results, and thus one type of these members are provided with display areas on their vertical faces and further provided with integral storage and display units adjacent their bottom surfaces. The second type has the vertical display surface only so that they may be combined to form one or more assemblies in which the unit having the display case will be flanked by the second type of units. The third type would be end members which close off and complement the other two types to provide a finished display system.

It has also been found that if the canopy is provided with three light sources, one may be brought to bear on the upright wall portions, while the remainder may be used to illuminate the display cases.

Additionally, coordinated freestanding display units may be provided and spaced outwardly from the attached display units, and additionally vertical surfaces of the upstanding wall members may be color-coded so that a plurality of articles may be displayed in a combination assembly, with each particular article, such as a given design of ring, having its own color coding.

Accordingly, production of an improved display unit of the character above-described becomes the principal object of this invention, with other objects thereof becoming more apparent upon a reading of the following brief specification, considered and interpreted in view of the accompanying drawings.

BRIEF DESCRIPTION OF THE PREFERRED EMBODIMENT

Figure 1:
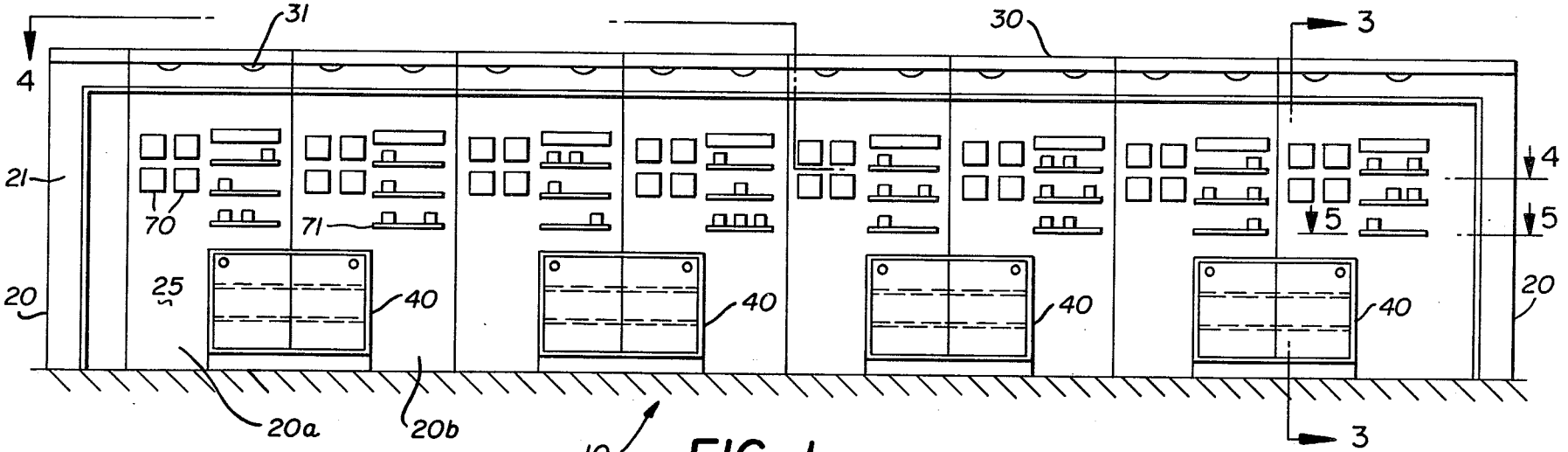
FIG. 1 is a front elevational view of a completed assembly.
Figure 2:
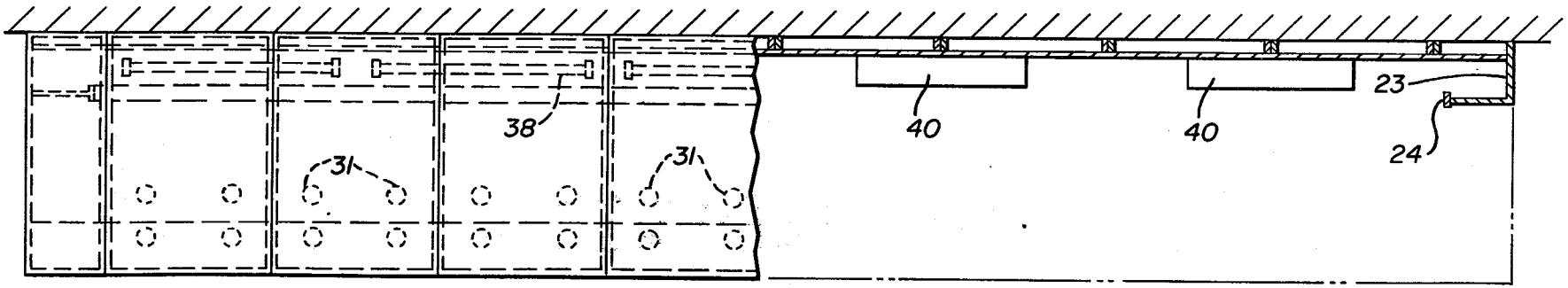
FIG. 2 is a top plan view partially broken away of the unit shown in FIG. 1.
Figure 6:
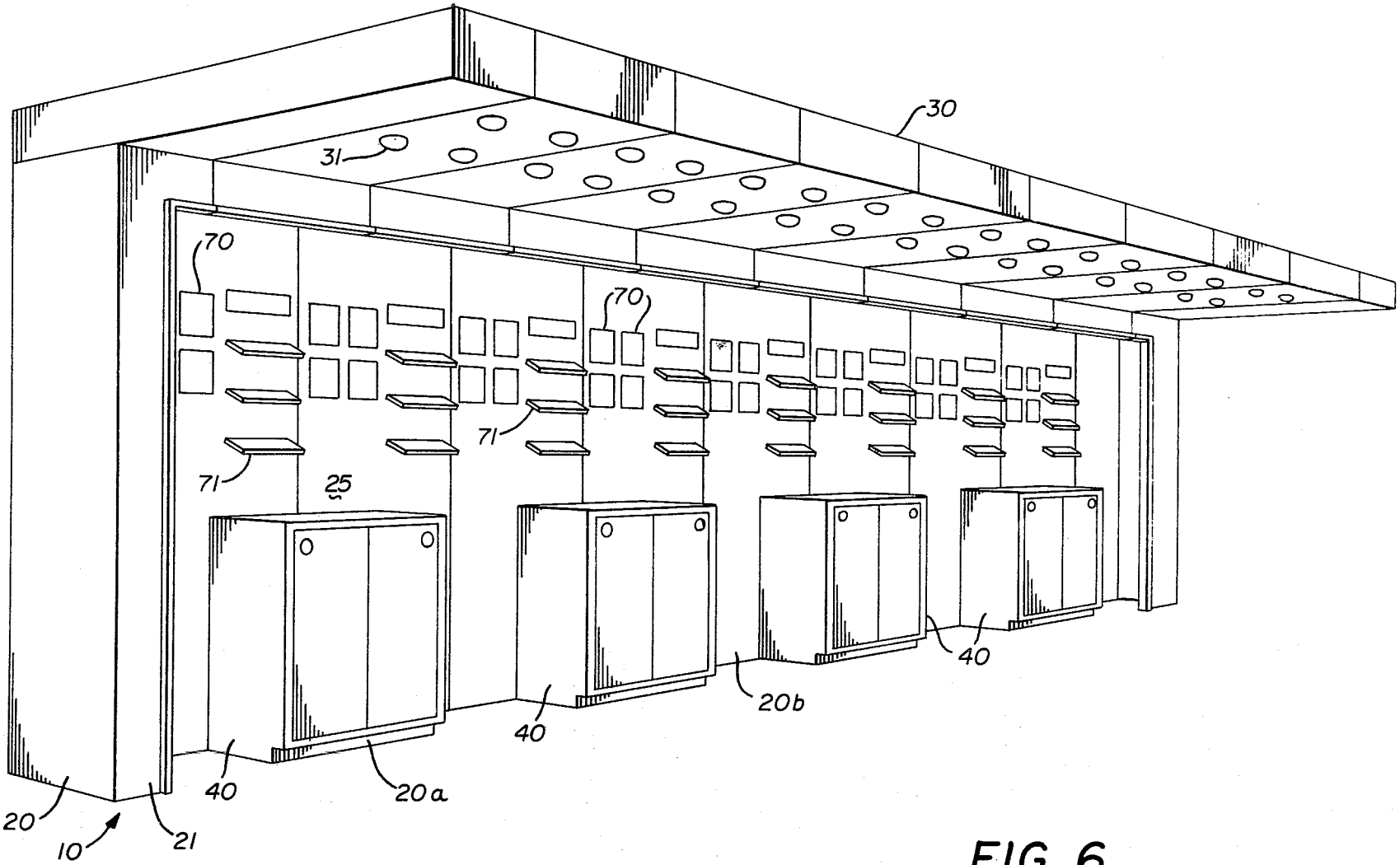
FIG. 6 is a perspective view of the completed assembly of FIG. 1.

Referring first to FIGS. 1 and 6, the overall display assembly, generally indicated by the numeral 10, consists of end units 20,20 and a plurality of upstanding units generally indicated by the numerals **20*a* and 20*b* which are arranged in alternating fashion. Integral with each of the upstanding units 20*a* and 20*b* and projecting from the top thereof is an overhanging canopy portion 30. Also, units 20*a*,20*a* have built-in display cabinets or showcases 40,40 mounted on the lower portion 5 of their vertical front surfaces, while units 20*b*,20*b*** have their lower surfaces plain.

Figures 3, 3A:
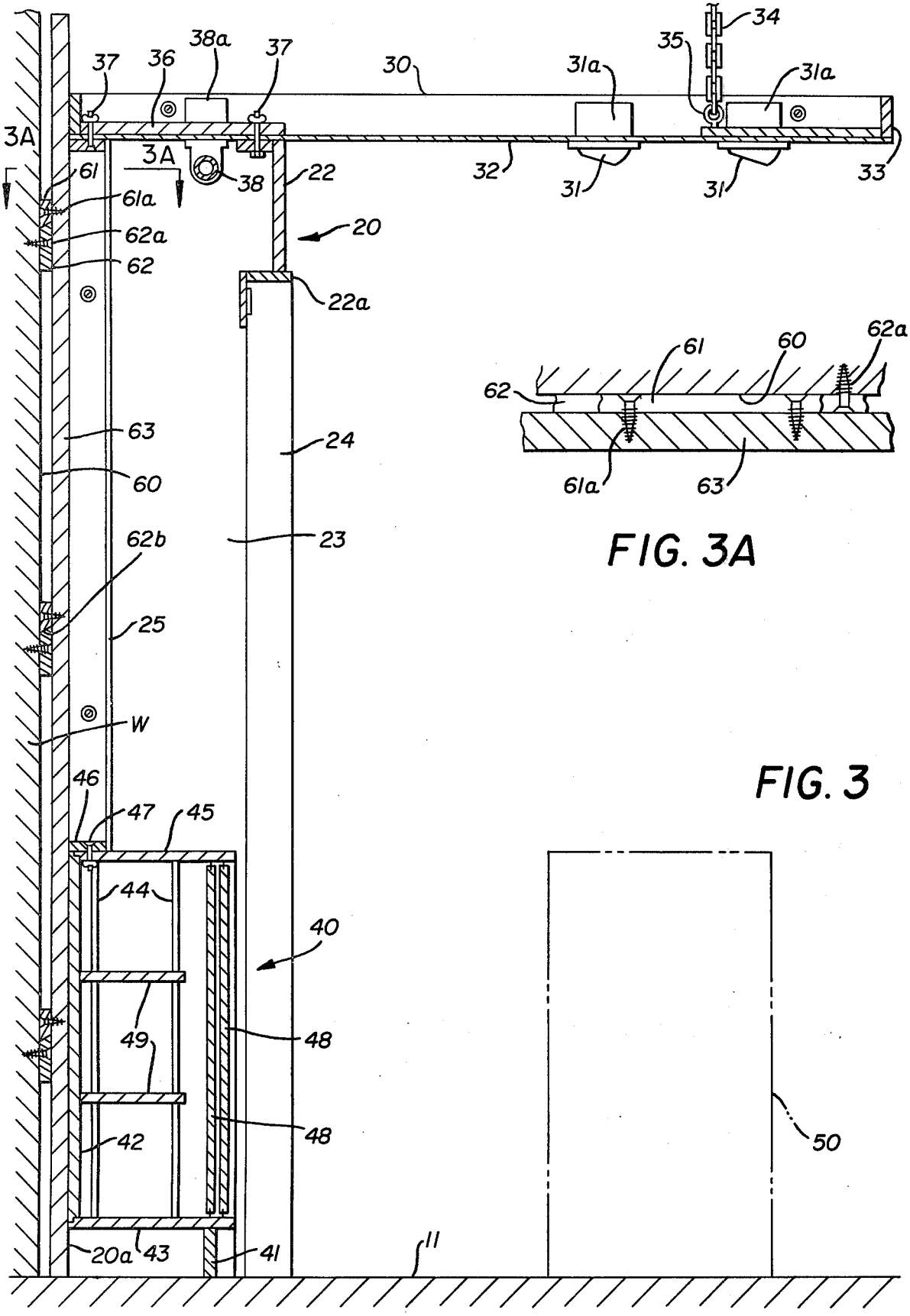
FIG. 3 is a sectional view taken along the line 3—3 of FIG. 1.
FIG. 3A is a sectional view taken along the line 3A—3A of FIG. 3.
Figure 4:
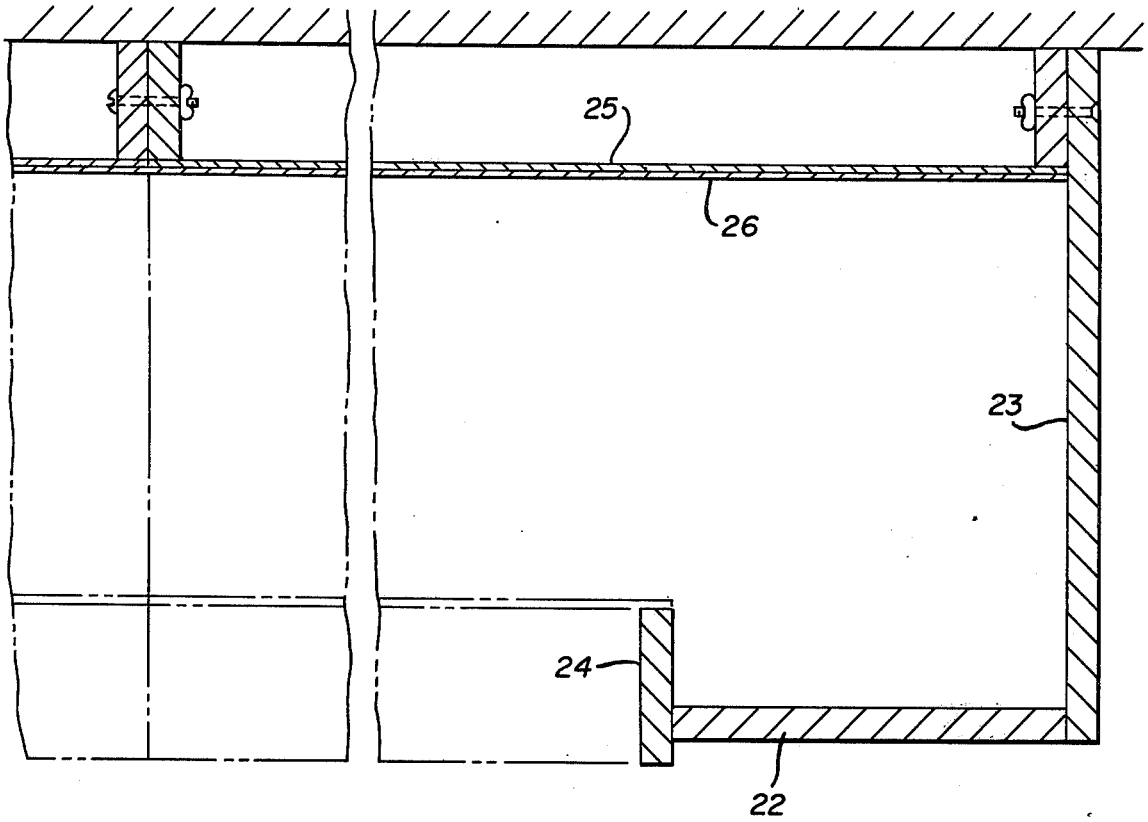
FIG. 4 is a partial sectional view taken along the line 4—4 of FIG. 1.
Figure 5:
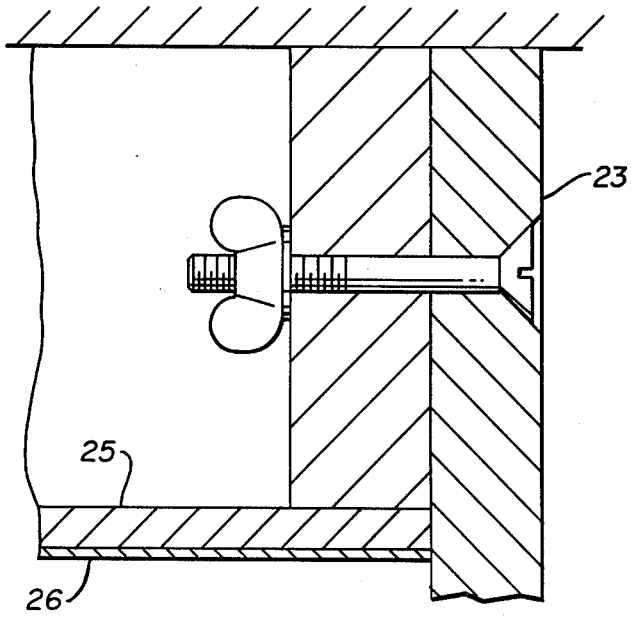
FIG. 5 is a sectional view taken along the line 5—5 of FIG. 1.

Referring to FIG. 3 for a more detailed description of the invention, it will be noted that each of the upstanding sections **20*a* and 20*b* includes a vertical display surface 25. This surface may be covered by felt or other suitable display material and also may be color-coded, if desired, to highlight a variety of products. Additionally, display means 70 and 71 are mounted on surface 25** and consist of shelves or graphic display units.

As noted above, alternate upright units **20*a*,20*a* have a display case 40 attached thereto and covering the lower portion thereof. As noted in FIG. 3, each of these display units 40 has a supporting leg member 41 and a rear wall 42 which is, in turn, attached to the upstanding member 20*a*. These units also have top and bottom walls 43 and 45 and supporting members 44,44 which support the shelves 49,49, as clearly shown in FIG. 3. Sliding doors 48,48, which may be of any desired material, are provided at the front, and the device is secured together by means of a framing member 46 and an anchor bolt 47**.

These cases, as well as the bottom of upstanding units **20*a*, rest on the floor 11**.

Each of the upstanding units **20*a* and 20*b* also has a canopy portion 30 which projects at right angles therefrom and parallel to floor 11. This canopy consists of an elongate base member 32 which terminates in an end piece 33. Mounted on the base member 32 are first and second adjustable light means 31, with appropriate junction boxes 31*a*,31*a* secured thereto in conventional fashion. A third fixed light source 38, which is illustrated as a florescent light, is also mounted thereon adjacent the back wall and also has its associated junction box 38*a*. A reinforcing framing member 36 is provided adjacent the inboard end of the base member 32 and is secured thereto by the anchor bolts 37,37. Depending from the support 36 is a downwardly extending projection or valence 22. The valence 22 terminates in a transverse member 22*a*, and in the endmost units 21,21 a further extension 24 is provided, and an end panel 23** is also secured to the device.

Due to the extent of the projection of the canopy 30, a chain 34 and an I-bolt 35 are provided to secure the device to the ceiling, if structurally necessary.

Furthermore and referring to FIGS. 3 and 3A of the drawings, it will be noted that the upstanding units 20*a*, 20*b*, and 21 can be mounted on the wall surface W, with the wall surface being provided with a frame 60 which is secured to the wall W by screws 62*a*. This frame has cleats 62,62 mounted thereon, and these have tapered surfaces 62*b*,62*b*. Mounted on the back 63 of the upstanding units 20*a*, 20*b*, and 21 are complementally contoured cleats 61,61 secured thereto by screws 61*a*,61*a*. Once the frame 60 has been mounted to the wall, it is then merely necessary to "hang" the upstanding units on the cleats 62,62 with the cleats 61,61.

Also provided and spaced from the unit 10 is a free-standing display case 50 which is optional and would be a conventional display case. Therefore, this display case has not been shown in any great detail.

Accordingly then, the overall system 10 basically consists of three different types of upstanding units 20*a*, 20*b*, and 21. The units 21,21 are the end units, while the units 20*a*,20*a* carry the display cases 40,40, and the units 20*b*,20*b* lack the display units and are capable of being alternated with units 20*a*,20*a* to form an aesthetically pleasing overall display system in any number of combinations as will now be described.

It should be noted that each of the upstanding members 20*a* and 20*b* with its associated canopy member is essentially four feet in width in the preferred form of the invention. Alternate units of this type will have the built-in display case 40 as shown in FIG. 1, and it is contemplated that a basic assembly would comprise two upstanding members 20*b*,20*b*, without the display case 40 flanking a central unit 20*a* with the display case, and two end units 21,21 to form a system 16 feet long. While this is one possible arrangement, it is believed apparent then that other multiples can be provided to stretch or shrink the unit to whatever length is required, depending upon the limitations of space in the store in which the unit is used, as well as the requirements of the user.

Thus, for example, it is also possible of course to utilize a minimum of two of the 4-foot sections 20*a* and 20*b* together with the end sections 21,21, and it is even possible to reduce this to a single section if necessary although, of course, there are certain aesthetic disadvantages when that type of arrangement is utilized. Conversely, of course, the unit could be expanded indefinitely, and, for example, FIGS. 1 and 6 show a 32 foot unit.

Furthermore, as noted, the surfaces 25 of the upstanding members 20*a* can be either covered with different types of material, so as to contrast them with adjacent faces, or covered with different colors of material so that a plurality of articles can be displayed in side-by-side relation, with each of them being distinctly set out and highlighted. This feature, combined with the alternating of the units 20*a* and 20*b*, provides an extremely pleasing assembly from an aesthetic viewpoint without sacrificing the utility thereof and, furthermore, makes it possible to display a multiplicity of items in a cohesive display unit which can be advantageously displayed in a store selling another line of products, for example.

Accordingly, utilization of an expandable display unit of this particular nature makes it possible to provide a very flexible display unit which is both aesthetically pleasing and highly functional in that it highlights the article being displayed. The device also has great flexibility in that it can be assembled in "modular" form so as, in effect, to be expanded dependent upon the desires of the user.

A typical unit, as shown in FIG. 1, is 36 feet in length and includes the opposed end units 20,20 and consists of four of the 4-foot upstanding units 20*a* with display cases 40,40, and four units 20*b* flanked by two end units 21,21. It is believed apparent, however, that the invention should not necessarily be limited to the particular 4 and 2 foot lengths illustrated and described, and that any desired lengths could be utilized with equal facility.

While a full and complete description of the invention has been set forth in accordance with the dictates of the Patent Statutes, it should be understood that modifications can be resorted to without departing from the spirit hereof or the scope of the appended claims.

What is claimed is:

1. An expandable display system comprising:

A. at least one first upstanding display unit having
   1. a vertical back wall with a forwardly presented planar display surface covering at least a portion of its surface area and
   2. an integral canopy projecting from the top of said back wall;

B. at least one second upstanding display unit having
   1. a vertical back wall with a forwardly presented planar display surface covering at least a portion of its surface area and
   2. an integral canopy projecting from the top of said back wall and
   3. a generally box-like display case secured to the lower portion of said back wall;

C. said first and second upstanding display units being arranged in side-by-side relationship with each other; and D. a light source carried by each of said canopies of each said first and second upstanding display units for illumination of said planar display surfaces of said upstanding display units and said display case;

E. Said light source including
   1. a first series of adjustable lights carried adjacent the outboard projecting end of each of said canopies; and
   2. a second series of adjustable lights carried by each of said canopies and spaced from said first series of lights.

2. The system of claim 1 further characterized by the presence of

A. opposed upstanding end units each having
   1. a vertical back wall with a forwardly presented planar display surface covering at least a portion of its surface area and
   2. an integral canopy projecting from the top of said back wall;

B. said end units being disposed adjacent opposed sides of said first and second upstanding display units and each having an end wall projecting substantially normal to said back wall.

3. The system of claim 1 further characterized by the presence of attachment means secured to and projecting from the rear surface of the vertical back wall of said first and second upstanding display units and adapted to releasably secure said units to an adjacent wall surface.

4. The system of claim 3 further characterized by the presence of a third series of fixed lights carried by said canopies adjacent their point of juncture with said back walls in overlying relationship to said display cases.

5. The system of claim 1 wherein said forwardly presented planar display surfaces of said back walls of said first and second upstanding units are alternately color coded.

6. The system of claim 1 further characterized by the presence of

A. a plurality of display members mounted on the forwardly presented planar display surfaces of said back walls.

* * * * *